US005715582A

United States Patent [19]

Zorzi

[11] Patent Number: 5,715,582

[45] Date of Patent: Feb. 10, 1998

[54] FASTENING DEVICE FOR SPORTS SHOES

[75] Inventor: Claudio Zorzi, Paderno Di Ponzano Veneto, Italy

[73] Assignee: Nordica S.p.A., Trevignano, Italy

[21] Appl. No.: 693,778

[22] Filed: Jul. 22, 1996

[30] Foreign Application Priority Data

Jul. 31, 1995 [IT] Italy ..... TV95A0096

[51] Int. Cl.[6] ..... A43C 11/00

[52] U.S. Cl. ..... 24/71 SK

[58] Field of Search ..... 24/68 R, 69 R, 24/70 R, 71 R, 68 SK, 69 SK, 70 SK, 71 SK; 36/50.5

[56] References Cited

U.S. PATENT DOCUMENTS

| | | | |
|---|---|---|---|
| 4,193,171 | 3/1980 | Lichowsky . | |
| 4,424,636 | 1/1984 | Everest | 24/70 SK X |
| 4,433,457 | 2/1984 | Chalmers, II et al. . | |
| 4,546,521 | 10/1985 | Ribaarits | 24/70 SK |
| 4,951,364 | 8/1990 | Marega . | |
| 5,383,258 | 1/1995 | Nicoletti | 24/71 SK X |

*Primary Examiner*—James R. Brittain

*Attorney, Agent, or Firm*—Guido Modiano; Albert Josif

[57] ABSTRACT

A fastening device for sports shoes, provided with at least two flaps to be joined, including: a lever arm; a traction element that is articulated, at one end, to the lever arm at a first axis; a base that is associated with one of the flaps and from which vertical walls protrudes for rotatably supporting the lever arm at a second axis; a rack associated with the other one of the flaps and can be detachably engaged by the other end of the traction element. The lever arm is constituted by a first element, which is articulated at one end to the vertical wall that protrudes from the base, and a second element, which is articulated to the opposite end of the first element at a third axis; the second element has a tab that protrudes beyond the third axis toward the vertical wall that protrudes from the base and interacts with the upper surface of the base during the rotation of the second element to open the lever arm.

23 Claims, 4 Drawing Sheets

FASTENING DEVICE FOR SPORTS SHOES

BACKGROUND OF THE INVENTION

The present invention relates to a fastening device for sports shoes.

It is known to fasten the flaps of sports shoes, such as for example ski boots, roller skates, or ice skates, with fastening devices having a base associated with one of the flaps to be fastened and from which two vertical walls protrude to rotatably support a lever arm. A traction element is articulated to the lever arm and engages engagement means associated with the other flap to be fastened.

Italian patent No. 182322 discloses a fastening device of this type.

One of the problems observed in this conventional fastening device is that it must protrude from the external profile of the shoe in order to form a fulcrum span, i.e., a distance between the axis of the traction element and the point where the lever arm is pivoted to the base. The larger said fulcrum span, the firmer the closure of the shoe. On the other hand, a device that protrudes excessively from the shoe is subjected to the impacts against external objects that occur during sports practice. Those impacts can cause accidental release or even the breakage of the fastening device, with consequences that, besides causing interruption of the sports practice, may be severe for the user. The sizing of said devices, therefore, is the result of a compromise between two contrasting requirements: the need to provide a device that ensures high degrees of fastening, and therefore protrudes considerably with respect to the shoe, and the need to provide a device that is not subjected to impacts and therefore has a low profile.

One should also consider that reducing the protrusion entails another drawback, which consists in the difficulty, for the user, in gripping the free end of the lever arm to open the device. The limited distance between the base and the arm in fact makes it difficult to insert the fingers below the lever arm; this operation is made even more difficult in shoes for winter sports, due to the fact that the user wears very thick gloves or mittens and due to the possible presence of snow or ice.

As a partial solution to this drawback, Italian application no. 30704 B/78 discloses a closure lever for ski boots that is composed of two parts, so that the end part of the lever, which is shorter than the upper one, is movable or can be lifted so as to allow easier release of the traction element. Although it is undoubtedly valid, this solution is not free from some drawbacks, which are mainly due to the necessarily small size of the end part. Some difficulty in fact remains for the user to grip the lever, worsened by the fact that the interface area between the two parts of the lever can freeze quickly. The reduced grip region makes it difficult for the user to perform deicing, thus preventing the possibility of the lever end part to move.

A similar device is described in U.S. Pat. No. 4,433,457 disclosing a lever having limited protrusion and provided with a liftable end part whose length is limited with respect to the remaining part. The same drawbacks observed for the previous solution are found.

SUMMARY OF THE INVENTION

The aim of the present invention is therefore to eliminate the drawbacks of the cited prior art by providing a fastening device for sports shoes whose protrusion with respect to the profile of the shoe is reduced, at the same time facilitating the operation for opening it on the part of the user.

Within the scope of this aim, an important object is to provide a fastening device that is immune to any accidental releases caused by impacts against external objects and is therefore safe in use, and at the same time ensures an effective fastening of the shoe.

An important object is to provide a device that is not subjected to jamming due to snow or ice and whose functionality can be easily restored by the user.

Another object is to provide a device that is structurally simple, can be produced with conventional machines and equipment, and has low manufacturing costs.

This aim, these objects, and others which will become apparent hereinafter are achieved by a fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

characterized in that said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
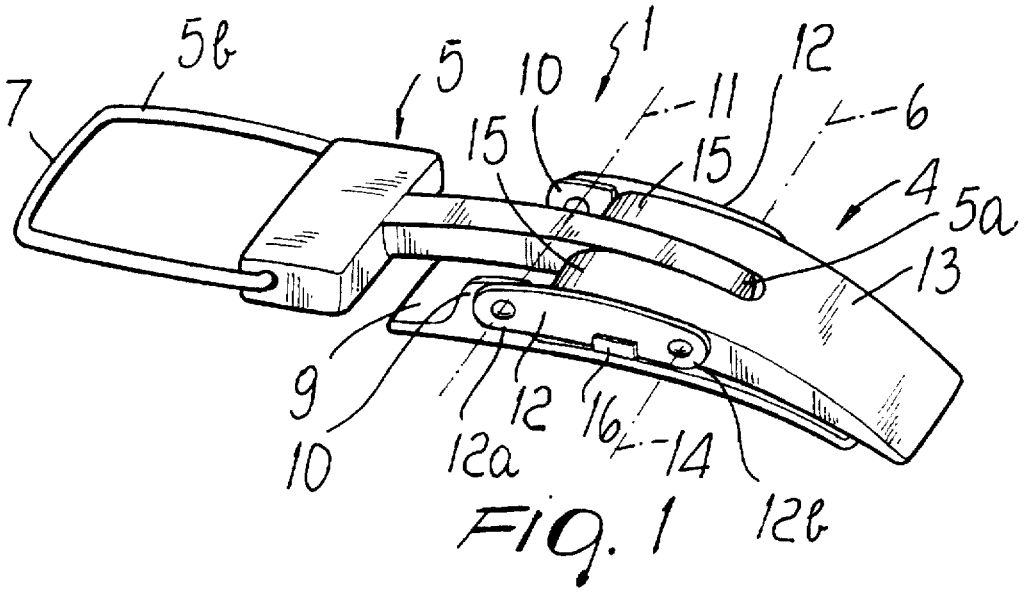
FIG. 1 is a general perpective view of the fastening device.
Figure 2:
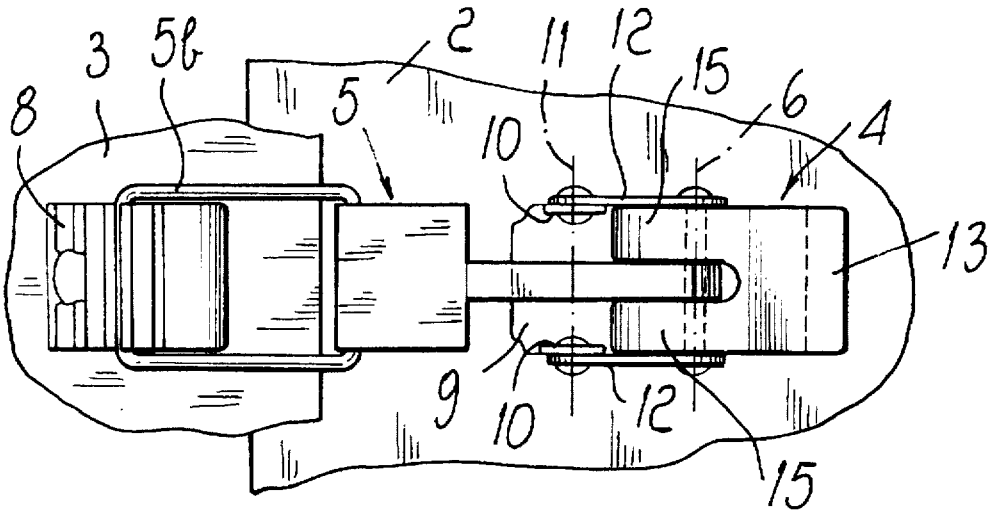
FIG. 2 is a top view of the device.

With reference to the figures, the reference numeral 1 designates a fastening device for sports shoes that have at least two flaps 2 and 3 to be mutually joined to close a shoe. The fastening device comprises: a lever arm 4; a traction element 5 that is articulated, at one end 5*a*, to lever arm 4 at a first axis 6 and has, at the opposite end 5*b*, grip means 7 for detachable engagement with appropriate engagement means 8 that are associated with the flap 3; a base 9, associated with flap 2, from which at least one vertical wall 10 protrudes and rotatably supports lever arm 4 at a second axis 11; in the particular embodiment shown in FIGS. 1 to 6, base 9 has two vertical walls 10.

Traction element 5 is preferably constituted by a T-shaped element that supports grip means 7, or in which grip means 7 is formed. The grip means can be constituted by conventional elements, such as a looped cable. The engagement means 8 is also constituted by conventional elements, such as a toothed rack.

Detailed description is omitted hereinafter also as regards the connection or articulation of the various elements to each other, by means for example of pivots or rivets or other conventional kinds of connecting means that can be immediately identified by the average person skilled in the art.

Lever arm 4 is constituted by at least one first element 12 and by a second element 13. First element 12 consists, in the particular illustrated embodiment, of two connecting rods that are articulated, at one end 12*a*, to the two vertical walls 10 at the second axis 11 and, at the opposite end 12*b*, to second element 13 at a third axis 14.

Advantageously, in the illustrated embodiment, third axis 14 coincides with first axis 6. In this manner, once lever arm 4 is in closed position, second element 13 is not affected by stresses, which are withstood entirely by first element 12.

Second element 13 has at least one tab 15 that protrudes beyond third axis 14 toward vertical wall 10. In the particular illustrated embodiment, second element 13 has two tabs 15 that are directed toward the pair of vertical walls 10 and between which there is a seat for accommodating traction element 5. The two connecting rods that constitute first element 12 are preferably but not necessarily associated externally with respect to tabs 15.

Tabs 15 are shaped so that in the closed position they are not in contact with the upper surface of base 9. During opening, tabs 15 begin to interact with the surface of base 9 starting from a preset rotation angle of second element 13 about third axis 14. An initial idle stroke of second element 13 is thus produced which moves it into a position that is more advantageous for applying the opening force.

A stroke limiting means is associated with first element 12 and with second element 13 and it is constituted by retainer means 16, associated with first element 12 or with second element 13, and by abutment surfaces 17, associated with the other one of said elements. In the particular illustrated embodiment, retainer means 16 is constituted by two projections that protrude from second element 13 and are arranged approximately parallel to third axis 14, whereas abutment surfaces 17 are constituted by the closed end of two grooves formed in the two connecting rods that constitute first element 12.

Figure 3:
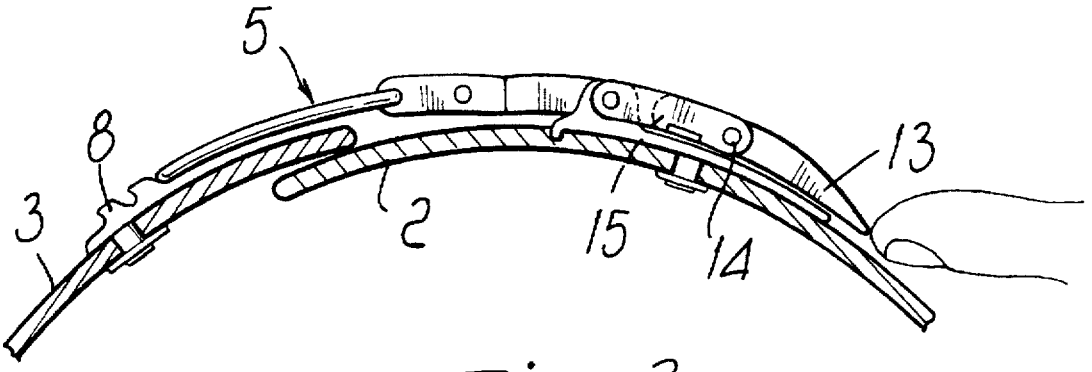
FIG. 3 is a side view of the device in closed position.
Figure 4:
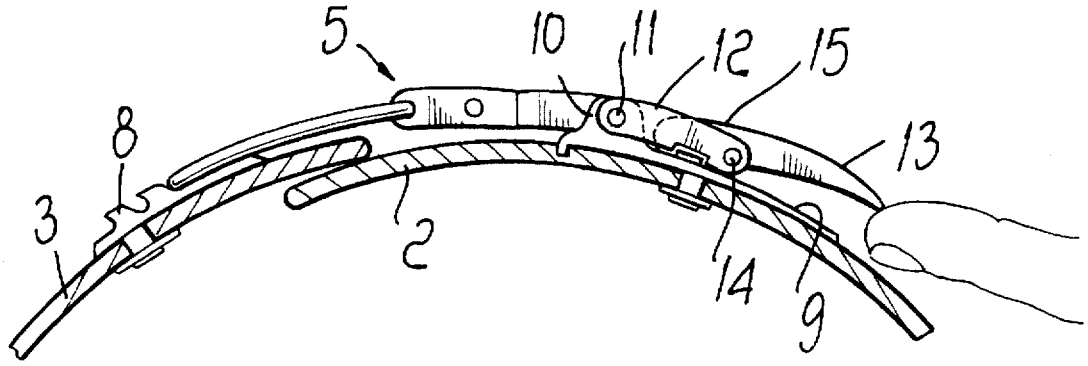
FIG. 4 is a view, similar to FIG. 3, of the device in a first intermediate opening position.
Figure 5:
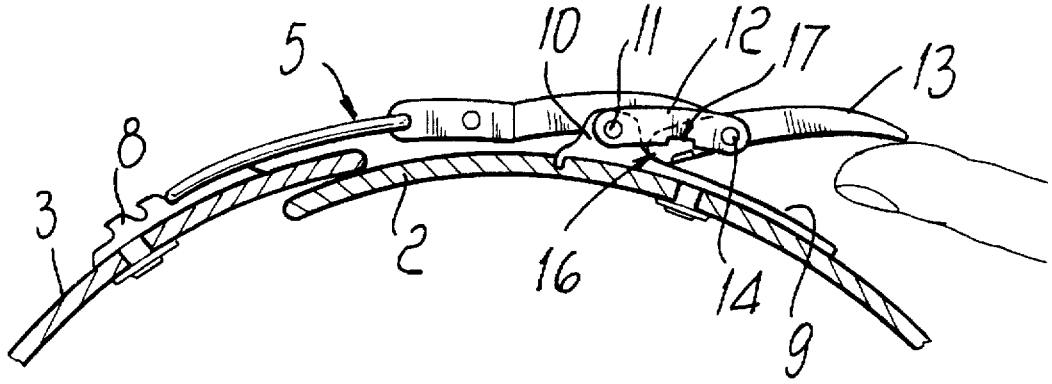
FIG. 5 is a view, similar to FIG. 4, of the device in a second intermediate opening position.
Figure 6:
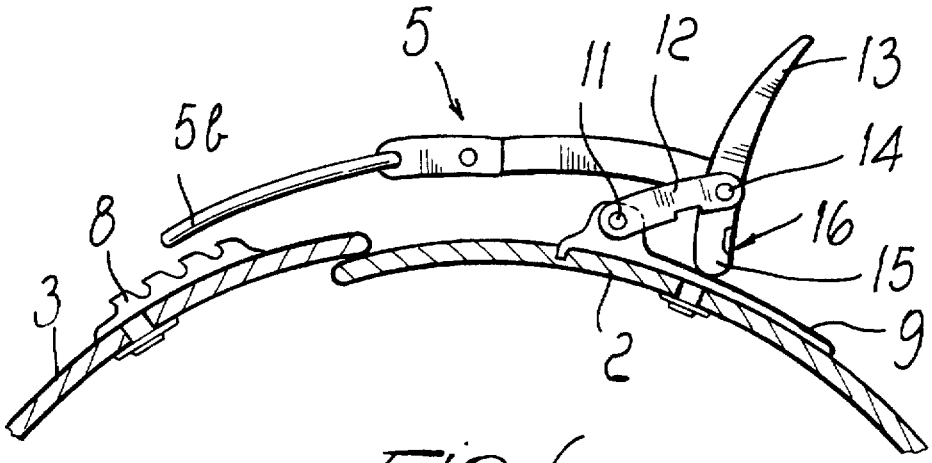
FIG. 6 is a view, similar to FIG. 5, of the device when fully open.

The operation of the device is as follows: starting from the closed condition shown in FIG. 3, in order to open the device the user must produce a first partial rotation of second element 13 about third axis 14. Since first axis 6 and third axis 14 coincide, thus keeping second element 13 free from stress in the closed position, and due to the shape of tabs 15, which are spaced from base 9, it is not necessary to apply any force to perform the first part of the rotation, which is therefore idle and has the purpose of allowing the user to insert his fingers under the free end of element 13, moving it to a position that is more advantageous for then applying the force required for opening. The final position of the first part of the rotation is shown in FIG. 4. Starting from this condition, tabs 15 start to interact with the upper surface of base 9, producing a reaction force that allows to apply the effort required for opening. The reaction force produces the rotation of the two connecting rods that constitute first element 12 about second axis 11, until first axis 6, which in this case coincides with third axis 14, passes beyond second axis 11. The conditions, shown in FIG. 5, for achieving full opening, which is shown in FIG. 6, are thus obtained.

During closure, first and second elements 12 and 13 behave as a single lever arm, because retainer means 16 rigidly couples elements 12,13 together by interacting with abutments surfaces 17 when first and second elements 12 and 13 are approximately aligned with respect to each other. Therefore, the closing operation is substantially identical to the operation of conventional lever-operated fastening devices and its description is accordingly omitted.

It has thus been observed that the invention has achieved the intended aim and objects, a device having been achieved having a reduced protrusion with respect to the profile of the shoe, and a nonetheless facilitated opening operation. The first idle part of the rotation of second element 13 has the purpose of allowing easy grip to the user to then apply the opening effort in more advantageous conditions. In this manner it is possible to provide a lever arm, composed of first element 12 and of second element 13, whose profile closely follows the profile of the underlying flap 2 of the shoe.

Furthermore, the device thus obtained allows to cushion any impacts against external objects without thereby causing accidental releases or breakages of the fastening device, since most of the energy due to the impact is discharged during the first idle part of the rotation of the second element 13 without being transmitted to the other loaded components of the device.

Finally, the dimensions of the components of the lever arm 4 are such as to prevent, or in any case allow to easily and quickly eliminate, any deposit of snow or ice that blocks the functionality of the components and jams the movements of the fastening device.

The invention thus conceived is of course susceptible of numerous modifications and variations, all of which are within the scope of the same inventive concept.

Figure 7:
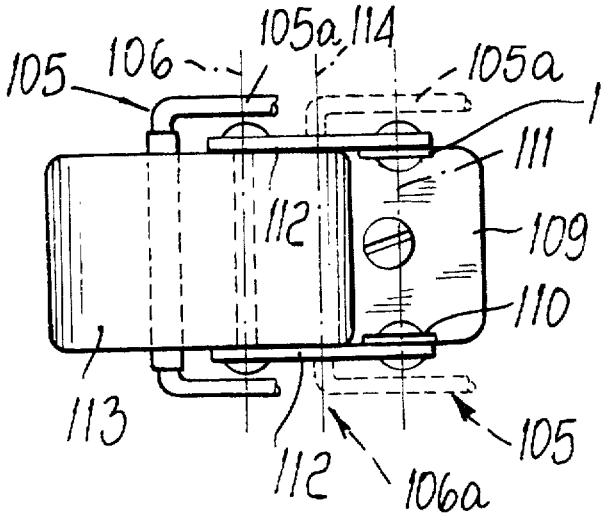
FIG. 7 is a top view of a second embodiment of the device.

Thus, for example, FIG. 7 illustrates a second embodiment, in which the traction element 105 is entirely constituted by a looped cable that is articulated, at one end 105*a*, to second element 113 at first axis 106 and can be detachably engaged at the other end, which constitutes the grip means, with a conventional engagement element, such as for example a toothed rack (not shown).

In this second embodiment, the relations between the forces that act on the device change, and therefore the force to be applied by the user in the first part of the rotation of second element 113 is not zero but is in any case less than the force that must be applied to a conventional lever arm.

As an alternative, the end 105*a* of traction element 105 can be articulated to first element 112, as shown in dashed lines in FIG. 7. In this manner, first axis 106*a* lies between second axis 111 and third axis 114. In this case, the first part of the rotation of element 113 entails no effort, but the effectiveness of the fastening is reduced, because first axis 106*a* is contiguous to second axis 111.

Figure 8:
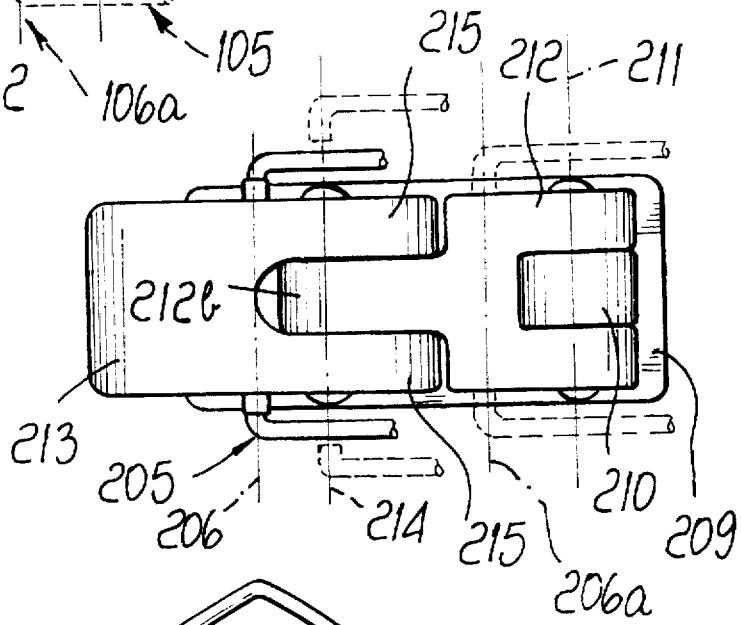
FIG. 8 is a view, similar to FIG. 7, of a third embodiment of the device.

FIG. 8 shows a third embodiment, in which the base 209 has a single vertical wall 210 to which first element 212 is articulated at second axis 211. The first element is constituted by a single component that is substantially Y-shaped. A seat is formed between tabs 215 of second element 213 to accommodate the end 212*b* of first element 212. In this embodiment, too, the first articulation axis of traction element 205 can be constituted by the axis 206 that belongs to second element 213, can coincide with third axis 214, or can be constituted by axis 206*a* that lies between second axis 211 and third axis 214.

Figure 9:
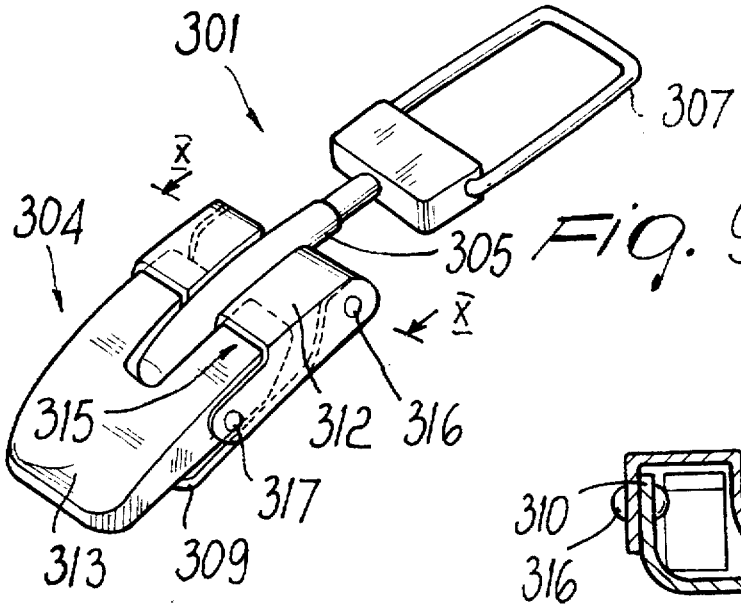
FIG. 9 is a perspective view of the fastening device according to a further embodiment of the invention.
Figure 10:
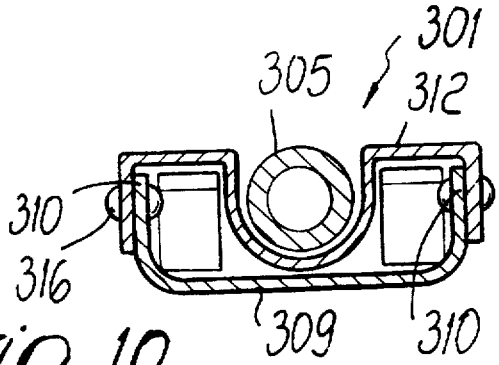
FIG. 10 is a cross section view of the device taken at the plane X—X of FIG. 9.

FIGS. 9 and 10 show a fastening device 301, according to a fourth embodiment of the invention, comprising a lever arm 304 constituted by a first element 312 articulated to a second element 313. First element 312 is hinged to vertical walls 310 of a base 309 adapted to be rigidly associated to a first flap of the shoe.

A traction element 305 is articulated to lever arm 304 by means of pivots 317 and has a grip means 307 adapted to engage a rack (not illustrated) rigidly associated with a second flap to be joined to the first flap of the shoe. Pivots 317 also support second element 313.

First element 312 is made of a one piece sheet metal, having a double U-shaped cross section (FIG. 10), in order to be articulated to base 309 by means of pivots 316 and to accommodate traction element 305 in an adapted central seat. The operation of fastening device 301 is substantially similar to the operation of the above-described embodiments.

The one piece construction of first element 313, however, provides several advantages. The lever arm assembly of this embodiment is more rigid and therefore has a more efficient and precise operation. This embodiment is also safer and durable.

Figure 11:
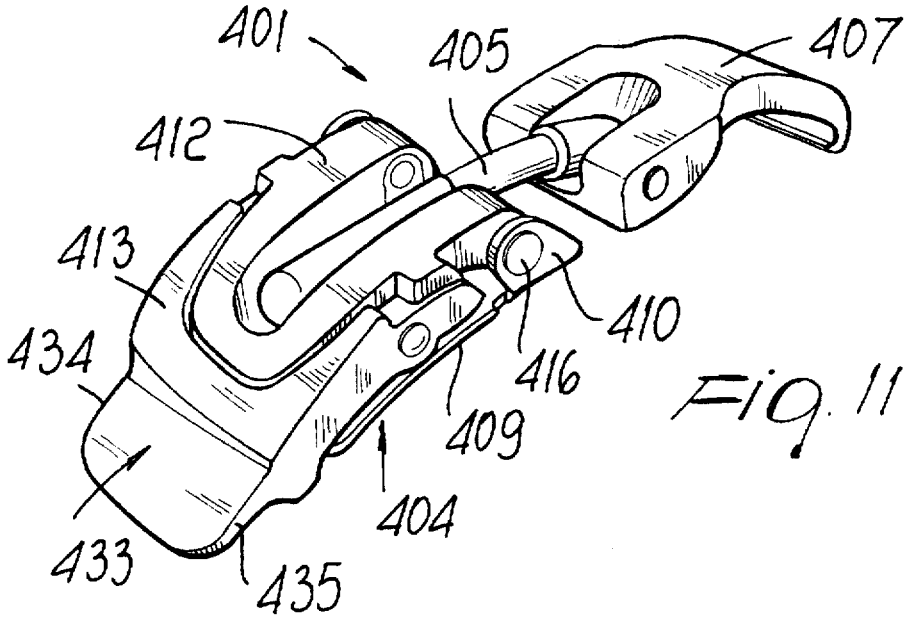
FIG. 11 is a perspective view of the device according to still a further embodiment of the invention.
Figure 12:
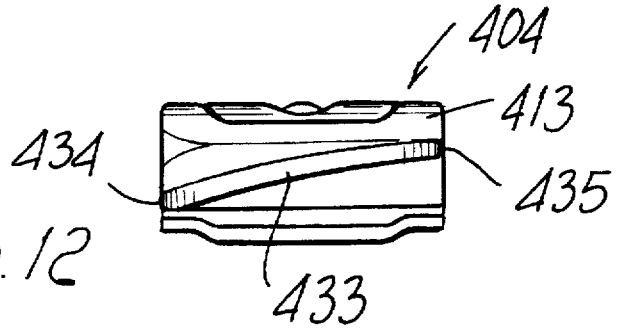
FIG. 12 is a front view of the device of FIG. 11.
Figure 13:
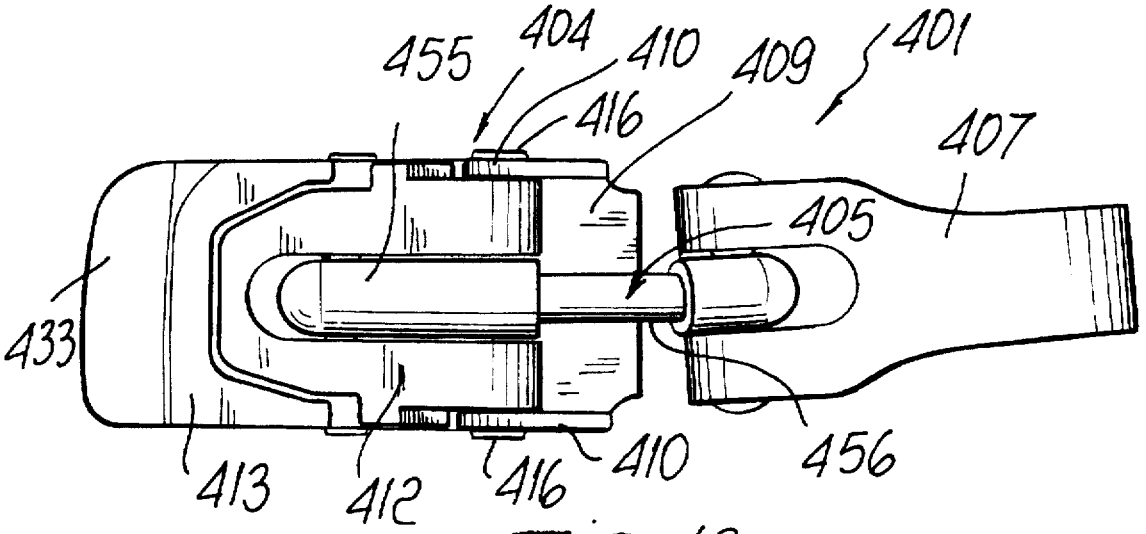
FIG. 13 is a top view of the device of FIG. 11.

FIGS. 11–13 show a fastening device 401, according to still a further embodiment of the invention, comprising a lever arm 404 constituted by a first element 412 articulated to a second element 413. First element 412 is hinged to vertical walls 410 of a base 409 adapted to be rigidly associated to a first flap of the shoe (not illustrated).

A traction element 405 is articulated to lever arm 404 and has a grip means 307 adapted to engage a rack (not illustrated) rigidly associated with a second flap to be joined to the first flap of the shoe. Traction element 405 is composed of a main member 455, hinged to lever arm 404, and associated with a screw member 456 for a fine adjustment of the working length of traction element 405.

First element 412 is made by working one solid piece and is articulated to base 409 by means of pivots 416. First element 412 has a substantially U-shaped cross section and defines a central seat for accommodating said traction element 405.

Second element 413, which is also preferably made of one piece, has a front transversely angled section 433 having a leading edge 434 almost flush with the shoe surface and therefore providing for an improved safety while the trail edge 435 of angled section 433 is raised to facilitate the insertion of the user's fingers for lifting the lever.

The operation of fastening device 401 is substantially similar to the operation of the above-described embodiments.

The materials employed, as well as the contingent shapes and dimensions of the individual components of the device, may be the most pertinent according to the specific requirements.

What is claimed is:

1. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein in the closure position said at least one tab is not in contact with the upper surface of said base; and wherein said at least one tab interacts with the upper surface of said base beyond a preset angle of rotation of said second element about said third axis during the opening of said lever arm.

2. Fastening device according to claim 1, wherein said first axis belongs to said second element.

3. Fastening device according to claim 1, wherein said first axis belongs to said second element, said traction element being articulated to said second element at one end.

4. Fastening device according to claim 1, wherein said lever arm is constituted by first elements that are articulated, at one end, to two vertical walls that protrude from said base, and by a second element that is articulated to the opposite end of said first elements, said second element having two tabs that protrude beyond said third axis toward said two vertical walls.

5. Fastening device according to claim 4, wherein said first elements consist of two connecting rods.

6. Fastening device according to claim 4, wherein a seat is formed between said two tabs to accommodate said traction element.

7. Fastening device according to claim 6, wherein said traction element is constituted by a T-shaped element that supports said grip means or in which said grip means are formed.

8. Fastening device according to claim 7, wherein said grip means are constituted by a looped cable.

9. Fastening device according to claim 1, wherein said traction element is entirely constituted by a looped cable that includes said grip means at one end.

10. Fastening device according to claim 1, wherein said engagement means are constituted by a toothed rack.

11. Fastening device according to claim 1, wherein said second element has a front transversely angled section having a leading edge close to said flap and a trail edge which is raised with respect of said flap to facilitate the insertion of the user's finger to lift said lever arm.

12. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first and third axes coincide.

13. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first axis lies between said second and third axes and belongs to said first element.

14. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein the end of said at least one tab is shaped so as to produce a first part of the rotation of said second element about said third axis, in which said at least one tab does not interact with the upper surface of said base, and a second part of the rotation, in which said at least one tab interacts with said upper surface until said grip means are disengaged from said engagement means.

15. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein during the closure of said lever arm said first and second elements are mutually rigidly coupled by stroke limiting means that are associated with said first and second elements; and wherein said stroke limiting means comprise retainer means, associated with said first element or with said second element, and abutment surfaces, formed on the other one of said first and second elements, said retainer means interacting with said abutment surfaces during the closure of said lever arm.

16. Fastening device according to claim 15, wherein said retainer means interacts with said abutment surfaces when said first and second elements are approximately mutually aligned.

17. Fastening device according to claim 16, wherein said retainer means is constituted by two protrusions that are arranged approximately parallel to said third axis and protrude from one of said first and second elements.

18. Fastening device according to claim 15, wherein said retainer means interacts with said abutment surfaces when said first and second elements are approximately mutually aligned, said abutment surfaces being constituted by the closed end of a pair of grooves.

19. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first and third axes coincide, said traction element being articulated, at one end, coaxially to said first and second elements.

20. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first axis lies between said second and third axes and belongs to said first element, said traction element being articulated to said first element at one end.

21. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said base has a single vertical wall to which said first element is articulated at said second axis, said first element being constituted by a single component that is substantially Y-shaped.

22. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first element is made of a one piece sheet metal and has a double U-shaped cross section defining a central seat for said traction element.

23. Fastening device for sports shoes provided with at least first and second flaps to be joined, comprising:

a lever arm;

a traction element that is articulated, at one end, to said lever arm at a first axis and has grip means at the opposite end adapted to grip engagement means provided on said second flap;

a base that is associated with said first flap and from which at least one vertical wall protrudes for rotatably supporting said lever arm at a second axis;

wherein said lever arm is constituted by at least one first element and at least one second element, said first element being articulated, at one end, to said at least one vertical wall at said second axis, said second element being articulated to the opposite end of said first element at a third axis and having at least one tab that protrudes beyond said third axis toward said at least one vertical wall; and wherein said first element is made of a one solid piece and has a substantially U-shaped cross section defining a central seat for said traction element.

* * * * *